US007178333B2

(12) United States Patent
Oka

(10) Patent No.: US 7,178,333 B2
(45) Date of Patent: Feb. 20, 2007

(54) HYDRAULIC CONTROL SYSTEM FOR HYDRAULIC EXCAVATOR

(75) Inventor: Hidekazu Oka, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 11/078,317

(22) Filed: Mar. 14, 2005

(65) Prior Publication Data

US 2005/0204734 A1 Sep. 22, 2005

(30) Foreign Application Priority Data

Mar. 18, 2004 (JP) ..... 2004-078841

(51) Int. Cl.
*F16D 31/02* (2006.01)

(52) U.S. Cl. ..... 60/421; 60/429; 60/430

(58) Field of Classification Search ..... 92/421, 92/428, 429, 430; 60/421, 428, 429, 430
See application file for complete search history.

(56) References Cited

U.S. PATENT DOCUMENTS 4,415,050 A * 11/1983 Nishida et al. ..... 180/6.48
5,148,676 A * 9/1992 Moriya et al. ..... 60/429
5,996,341 A 12/1999 Tohji
6,148,548 A * 11/2000 Tohji ..... 37/348
6,708,490 B2 * 3/2004 Toji et al. ..... 60/421
2003/0037465 A1 2/2003 Toji et al.
2005/0204734 A1 9/2005 Oka

FOREIGN PATENT DOCUMENTS

EP 1 146 175 A1 10/2001
JP 10-102547 4/1998

OTHER PUBLICATIONS

U.S. Appl. No. 11/426,701, filed Jun. 27, 2006, Oka.

* cited by examiner

*Primary Examiner*—Hoang Nguyen
(74) *Attorney, Agent, or Firm*—Oblon, Spivak, McClelland, Maier & Neustadt, P.C.

(57) ABSTRACT

A hydraulic control system for a hydraulic excavator of the present invention comprises a boom control valve in a first oil path for providing pressure oil from a first hydraulic pump with a boom cylinder according to operation of a boom operating means, an arm control valve in a second oil path for providing pressure oil from a second hydraulic pump with an arm cylinder according to operation of an arm operating means, a confluence switching valve having a confluence position for joining the paths and a confluence stop position for stopping the confluence, a flow control valve for returning pressure oil in the first oil path to a tank, and a control means for controlling the valves, so as to switch the confluence switching valve to the confluence position and close the flow control valve when the arm operating means is operated independently and so as to switch the confluence switching valve to the confluence stop position and open the flow control valve when both of the operating means are operated simultaneously, thereby, the arm pulling operation is performed independently, an arm cylinder speed increases and a leveling efficiency is improved.

4 Claims, 3 Drawing Sheets

HYDRAULIC CONTROL SYSTEM FOR HYDRAULIC EXCAVATOR

BACKGROUND OF THE INVENTION

1. Field of the Invention

The present invention relates to a hydraulic control system for controlling a hydraulic actuator for a hydraulic excavator.

2. Description of the Related Art

According to a conventional method for performing a leveling work with use of a hydraulic excavator, a front end of a bucket is brought into contact with the ground while a boom and an arm are extended to a maximum and then boom raising operation and arm pulling operation are performed simultaneously to pull the bucket toward the excavator.

In the leveling work, when the arm assumes a nearly vertical attitude, a peripheral speed of the bucket front end becomes low relative to a cylinder speed of an arm cylinder, so there sometimes occurs a case where the cylinder speed of the arm cylinder is insufficient when the leveling efficiency is to be improved.

There is known a hydraulic excavator capable of solving the problem of delay in the boom speed which occurs upon simultaneous execution of the boom raising operation and the arm pulling operation (see, for example, Japanese Patent Laid-Open No. Hei 10-102547).

This known hydraulic excavator is configured in such a manner that the cylinder speed of a boom cylinder which is set for a fine operation taking the lifting work into account can be increased in the leveling work so as to permit operation at a speed matching a high arm speed.

In this hydraulic excavator, the boom whose speed is set for the fine operation can be actuated while allowing its speed to match the arm speed in the leveling work, but the excavator is not so configured as to permit an increase of the arm cylinder speed in the case where only the arm pulling operation is performed in the nearly vertical attitude of the arm.

SUMMARY OF THE INVENTION

It is an object of the present invention to provide a hydraulic control system in an hydraulic excavator wherein a boom cylinder and an arm cylinder can be operated each independently when boom raising operation and arm pulling operation are performed simultaneously in a leveling work, while when the arm pulling operation alone is performed, the speed of the arm cylinder can be increased to improve the leveling work efficiency.

The hydraulic control system for a hydraulic excavator according to the present invention comprises, as a basic configuration thereof, a boom control valve adapted to provide pressure oil from a first hydraulic pump with a boom cylinder in accordance with operation of a boom operation means, the boom control valve being disposed in a first oil path, an boom control valve adapted to provide pressure oil from a second hydraulic pump with an arm cylinder in accordance with operation of an arm operation means, the arm control valve being disposed in a second oil path, a confluence switching valve adapted to switch between a confluence position for joining the pressure oil from the first and second oil paths and a confluence stop position for stopping the joining, a flow control valve disposed in a return oil path for returning the pressure oil present in the first oil path to a tank, and a control means for controlling the confluence switching valve and the flow control valve.

The control means is configured so as to switch the confluence switching valve to the confluence position and to make the flow control valve in a closed position when the arm operating means is operated independently and so as to switch the confluence switching valve to the confluence stop position and to make the flow control valve in an opened position when arm operating means and boom operating means are operated substantially simultaneously.

According to this configuration, by an automatic switching of the confluence switching valve and the flow control valve, when boom raising and arm pulling operations are performed simultaneously, the respective cylinders of boom and arm can be operated each independently, and in case of performing the arm pulling operation alone, it is possible to increase the speed of the arm cylinder. Consequently, for example when the arm assumes a nearly vertical attitude and the arm speed becomes insufficient in a leveling work, it is possible to increase the flow rate of the pressure oil fed to the arm cylinder. As a result, the problem that the peripheral speed at a front end of a front attachment becomes low is solved and it is possible to improve the leveling work efficiency.

BREIF DESCRIPTION OF THE DRAWINGS

DESCRIPTION OF THE PREFERRED EMBODIMENTS

Figure 1:
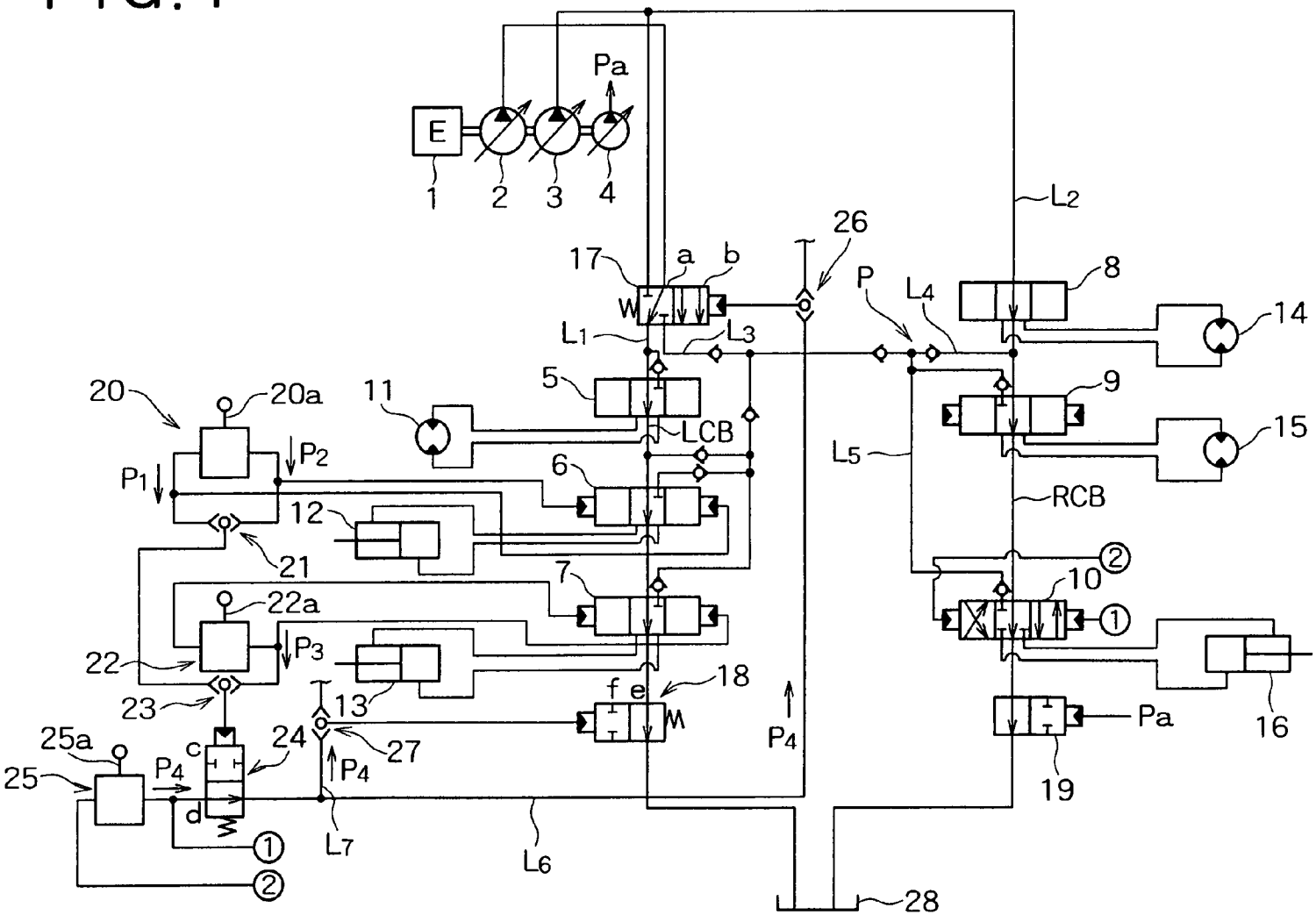
FIG. 1 is a hydraulic circuit diagram according to a first embodiment of the present invention.

The present invention will be described in detail hereinunder by way of embodiments thereof illustrated in the drawings.

FIG. 1 illustrates a hydraulic control circuit (hydraulic control system) in a hydraulic excavator according to a first embodiment of the present invention.

The hydraulic excavator, though not shown, comprises a lower traveling body and an upper rotating body mounted rotatably on the lower traveling body, with a front attachment being attached to a front portion of the upper rotating body. The front attachment comprises a boom, an arm and a bucket.

In the same figure, a first hydraulic pump 2, a second hydraulic pump 3 and a pilot pump 4 for producing a pilot pressure Pa are actuated by operation of an engine 1.

The first and second hydraulic pumps 2, 3 are variable capacity pumps. A discharge flow rate in each of the pumps varies in accordance with an inclination angle of a swash plate.

Pressure oil discharged from the first and second hydraulic pumps 2, 3 is fed to a right traveling motor control valve 5, a bucket cylinder control valve 6 and a boom cylinder control valve (boom control valve) 7 which are disposed in a left center bypass line (first oil path) LCB and is also fed to a left traveling motor control valve 8, a swing motor control valve 9 and an arm cylinder control valve (arm control valve) 10 which are disposed in a right center bypass line (second oil path) RCB.

A right traveling motor 11, a bucket cylinder 12, and a boom cylinder 13, are connected to the right traveling motor control valve 5, the bucket cylinder control valve 6, and the boom cylinder control valve 7, respectively, and pressure oil is fed to the respective actuators through the control valves.

Likewise, a left traveling motor 14, a swing motor 15, and an arm cylinder 16, are connected to the left traveling motor control valve 8, the swing motor control valve 9, and the arm cylinder control valve 10, respectively.

A straight traveling valve (confluence switching valve) 17 is disposed in an upstream oil path L1 formed on the upstream of the right traveling motor control valve 5. When a leveling work to be described later is not performed, the straight traveling valve 17 is switched so as to ensure straight traveling stability as a conventional function.

More specifically, the straight traveling valve 17 has a flow dividing position a as a confluence stop position and a confluence position b and is normally held at the flow dividing position a. At the flow dividing position a, pressure oil discharged from the first hydraulic pump 2 is fed to the left center bypass line LCB through the oil path L1, while pressure oil discharged from the second hydraulic pump 3 is fed to the right center bypass line RCB through an oil path L2.

In this case, the pressure oil from the first hydraulic pump 2 and the pressure oil from the second hydraulic pump 3 are fed each independently to the right traveling motor control valve 5 and the left traveling motor control valve 8.

Next, when the straight traveling valve 17 is switched from the flow dividing position a to the confluence position b, the pressure oil from the first hydraulic pump 2 is fed through an oil path L3. At a connecting point P, this oil path L3 is connected with an oil path L4 divided from a downstream side of the left traveling motor control valve 8 in the RCB. And the pressure oil is provided with the swing motor control valve 9 and the arm control valve 10 through an oil path L5 extended from the connecting point P. Apart of the pressure oil flowing in the path L3 is also able to be provided with the bucket cylinder control valve 6 and the boom cylinder control valve 7.

The pressure oil from the second hydraulic pump 3 is divided to flows in parallel through the oil paths L1 and L2 and is fed and distributed to the left and right traveling motor control valves 8, 5. As a result, even when a composite operation is performed such as, for example, a boom hoisting operation under operation of the right and left traveling motors 11, 14, the pressure oil from the second hydraulic pump 3 is fed equally to right and left traveling motors 11, 14, whereby the straight traveling stability can be ensured.

A left cut-off valve (flow control valve) 18 is disposed on the downstream (return oil path) side of the boom cylinder control valve 7 in the left center bypass line LCB and a right cut-off valve 19 is disposed on the downstream side of the arm cylinder control valve 10 in the right center bypass line RCB.

Next, switching control system of the straight traveling valve 17 and the cut-off valve 18 will be explained hereafter. To the circuit in FIGS. 1 and 2, a bucket operating remote control valve 20 with a bucket operating lever 20*a*, a boom operating remote control valve (boom operating means) 22 with a boom operating lever 22*a*, and an arm operating lever 25*a* are connected. Those remote control valves 20, 22, 25 output a pilot pressure according to an operating direction and an operating amount of each of those operating levers 20*a*, 22*a*, 25*a*.

Pilot pressures P1 and P2 outputted from the bucket operating remote control valve 20 are provided to respective pilot ports in the bucket cylinder control valve 6. Either the pilot pressure P1 or P2 is selected by a high-order selection which is made by a shuttle valve 21. The pilot pressure P1 (or P2) thus selected by the high-order selection and a boom raising pilot pressure P3 outputted from the boom operating remote control valve 22 are further subjected to a high-order selection by a shuttle valve (detecting means for detecting a boom raising operation pressure) 23. That is, the shuttle valves 21 and 23 are adapted to detect a composite operation.

The pilot pressure selected by the shuttle valve 23 is provided to a pilot port of a flow control valve (control means) 24. The flow control valve 24 is adapted to be switched between a cut-off position c and a communicating position d and is normally held at the communicating position d.

A portion of an arm pulling pilot pressure P4, which is outputted from the arm operating remote control valve 25 by operation of an arm operating lever (arm operating means) 25*a*, is provided to the flow control valve 24. The arm pulling pilot pressure P4 outgoing from the flow control valve 24 is provided to a pilot port of the straight traveling valve 17 through an oil path L6 and a shuttle valve 26. The shuttle valve 26 makes a high-order selection out of a pilot pressure based on simultaneous operation of traveling operation and attachment operation and the arm pulling pilot pressure P4.

An oil path L7 which branches from the oil path L6 is connected to a pilot port of the left cut-off valve 18 through a shuttle valve 27. The shuttle valve 27 makes a high-order selection out of an operating pressure other than the arm pulling pilot pressure (e.g., arm pushing pilot pressure) and the arm pulling pilot pressure P4.

Numeral 28 in the figure denotes a return oil tank.

In this embodiment, the straight traveling valve 17 is used as a confluence switching valve. The straight traveling valve 17 makes switching between the flow dividing position a (first switching position) in which the pressure oil from the first hydraulic pump 2 and the pressure oil from the second hydraulic pump 3 are fed each independently to the LCB (first oil path) and RCB (second oil path) and thence to the traveling motor 11 disposed in the LCB as the first oil path and the traveling motor 14 disposed in the RCB as the second oil path, and the confluence position b (second switching position) in which the pressure oil from either the first hydraulic pump 2 or the second hydraulic pump 3 is distributed to the traveling motors 11 and 14. In this case, the effect of the present invention can be exhibited without any great design alteration of the existing circuit.

The following description is now provided about the operation of the hydraulic control system described above.

When the arm pulling operation alone is performed in the leveling work or the like or when the arm pulling operation alone is performed as a result of the boom raising operation being stopped during simultaneously simultaneous operation of boom raising and arm pulling operations, a pilot pressure is not provided from the bucket operating lever 20*a* or the boom operating lever (boom operating means) 22*a* to the pilot port of the flow control valve 24. Consequently, a portion of the pilot pressure P4 flows in the oil paths L6 and L7 through the communicating position d of the flow control valve 24.

In this case, the pilot pressure P4 is provided to the pilot port of the straight traveling valve 17 through the oil path L6 and is also provided to the pilot port of the left cut-off valve 18 through the oil path L7, whereby the straight traveling valve 17 switches from the flow dividing position a to the confluence position b and the left cut-off valve 18 switches from a communicating position e to a cut-off position f.

When the straight traveling valve 17 switches to the confluence position b, the pressure oil from the first hydraulic pump 2 is fed to the arm cylinder control valve 10 through the oil paths L3 to L5. On the other hand, the pressure oil from the second hydraulic pump 3 flows through the oil paths L2 to L4 because the left cut-off valve 18 in LCB is closed, and in the oil path L5 it joins the pressure oil from the first hydraulic pump 2.

Consequently, when the arm pulling operation alone is performed, the flow rate of pressure oil fed to the arm cylinder control valve 10 increases and it is possible to increase the cylinder speed of the arm cylinder 16.

On the other hand, when the boom raising and arm pulling operations are performed substantially simultaneously, the boom raising pilot pressure P3 is provided to the pilot port of the flow control valve 24 through the shuttle valve 23 and the flow control valve 24 is switched from the communicating position d to the cut-off position c.

When bucket excavation and bucket release are operated in the leveling work, the flow control valve 24 also switches from the communicating portion d to the cut-off position c upon receipt of the pilot pressure P1 (or P2).

When the arm operating remote control valve 25 and the oil path L6 are cut off, a pilot pressure is not developed in the oil paths L6 and L7, the straight traveling valve 17 switches from the confluence position b to the flow dividing position a and the left cut-off valve 18 switches from the cut-off position f to the communicating position e.

In this case, therefore, the pressure oil from the first hydraulic pump 2 and the pressure oil from the second hydraulic pump 3 do not join, but as the pressure oil from the first hydraulic pump 2 is fed to the boom cylinder control valve 7 and the pressure oil from the second hydraulic pump 3 is fed to the arm cylinder control valve 10, whereby operating pressures for valves can be ensured.

Of course, the straight traveling valve 17 and the left cut-off valve 18 are configured so as to be switched by ON-OFF operation (opening and closing operation). The straight traveling valve 17 and the left cut-off valve 18 are also configured so as to switch gradually in proportion to the operation amount of the boom operating lever 22*a*, instead of by ON-OFF operation. Therefore, the confluence and flow division can be switched from one to the other without causing any shock.

Thus, it is preferable that the straight traveling valve 17 and the left cut-off valve 18 be configured so as to switch in proportion to the operation amount of the boom operating lever 22*a*. According to this configuration, in the arm pulling operation, the straight traveling valve 17 and the left cut-off valve 18 are switched gradually without any shock.

When the boom raising and arm pulling operations are performed simultaneously, the straight traveling valve 17 is switched to the flow dividing side and the left cut-off valve 18 is opened as the operation amount of the boom operating lever 22*a* increases, and thus a shock-free operation is ensured.

As to the pump flow rate on the confluence side, in the case of a negative control device, a negative control pressure drops and the flow rate increases upon closure of the left cut-off valve 18, while in the case of a positive control valve and if control is to be made hydraulically, the pump flow rate of the first hydraulic pump 2 can be increased with the pilot pressure which is for switching the straight traveling valve 17 and the left cut-off valve 18.

The afore-mentioned flow control valve 24 and the shuttle valve 26 are constituted as a control means which is adapted to switch the position of the straight traveling valve 17 according to the condition of an arm operation and a boom operation. This straight traveling valve 17 serves as well for a confluence switching valve for switching supplying condition of the pressure oil from the pumps 2,3 to the boom cylinder control valve 7 and the arm cylinder control valve 10.

Figure 2:
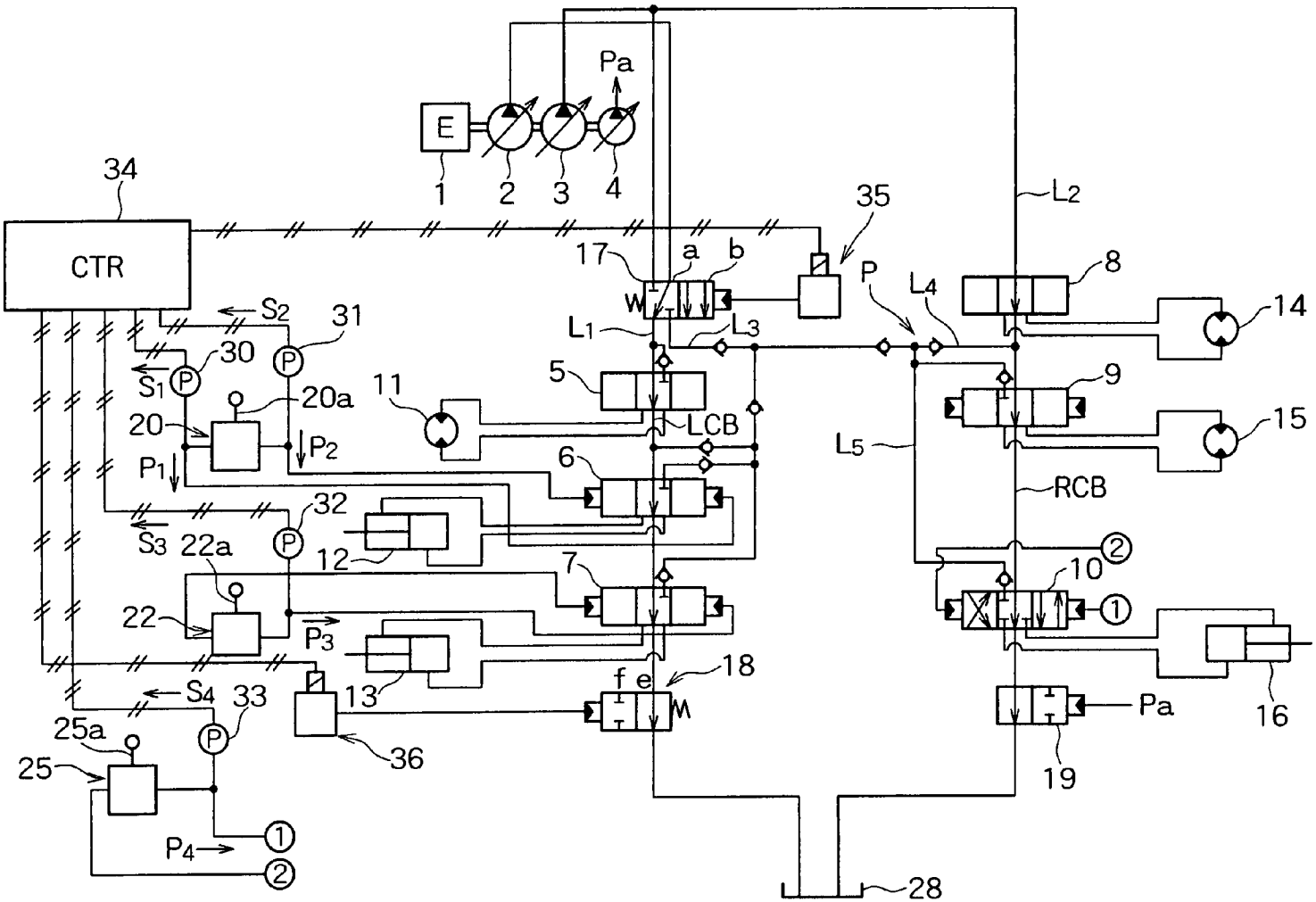
FIG. 2 is a hydraulic circuit diagram according to a second embodiment of the present invention.

FIG. 2 illustrates a second embodiment of the present invention, in which the above control for confluence and flow division is performed electrically using a controller.

In FIG. 2, the same constituent elements as in FIG. 1 are identified by the same reference numerals as in FIG. 1, and explanations thereof will be omitted.

In FIG. 2, bucket pilot pressure sensors 30 and 31 are provided on the secondary side of a bucket operating remote control valve 20. A bucket excavation pilot pressure S1 and a bucket release pilot pressure S2 are outputted as electric signals from the sensors 30 and 31 respectively.

A boom pilot pressure sensor (detecting means for detecting a boom raising operation pressure) 32 is provided on the secondary side (boom raising side) of a boom operating remote control valve 22 and a boom raising pilot pressure S3 is outputted from the sensor 32.

The sensors 30 to 32 are adapted to detect a composite operation of actuators.

Further, an arm pilot pressure sensor 33 is provided on the secondary side (arm pulling side) of an arm operating remote control valve 25 and an arm pulling pilot pressure S4 is outputted from the sensor 33.

The pilot pressures S1 to S4 are provided to a controller 34. In accordance with the pilot pressures S1 to S4 the controller 34 controls a proportional valve 35 connected to a pilot port of a straight traveling valve 17 and also controls a left cut-off valve 18 through a proportional valve 36. The controller 34 and the proportional valve 36 function as control means.

Reference will be made below to the contents of control performed by the controller 34 in accordance with the flow chart of FIG. 3.

In the same figure, the controller 34 makes a high-order selection out of the boom raising pilot pressure S3, the bucket excavation pilot pressure S1 and the bucket release pilot pressure S2 (step S1). As a result, a pilot pressure as an operating pressure is selected and is made a pilot pressure f0.

Figure 3:
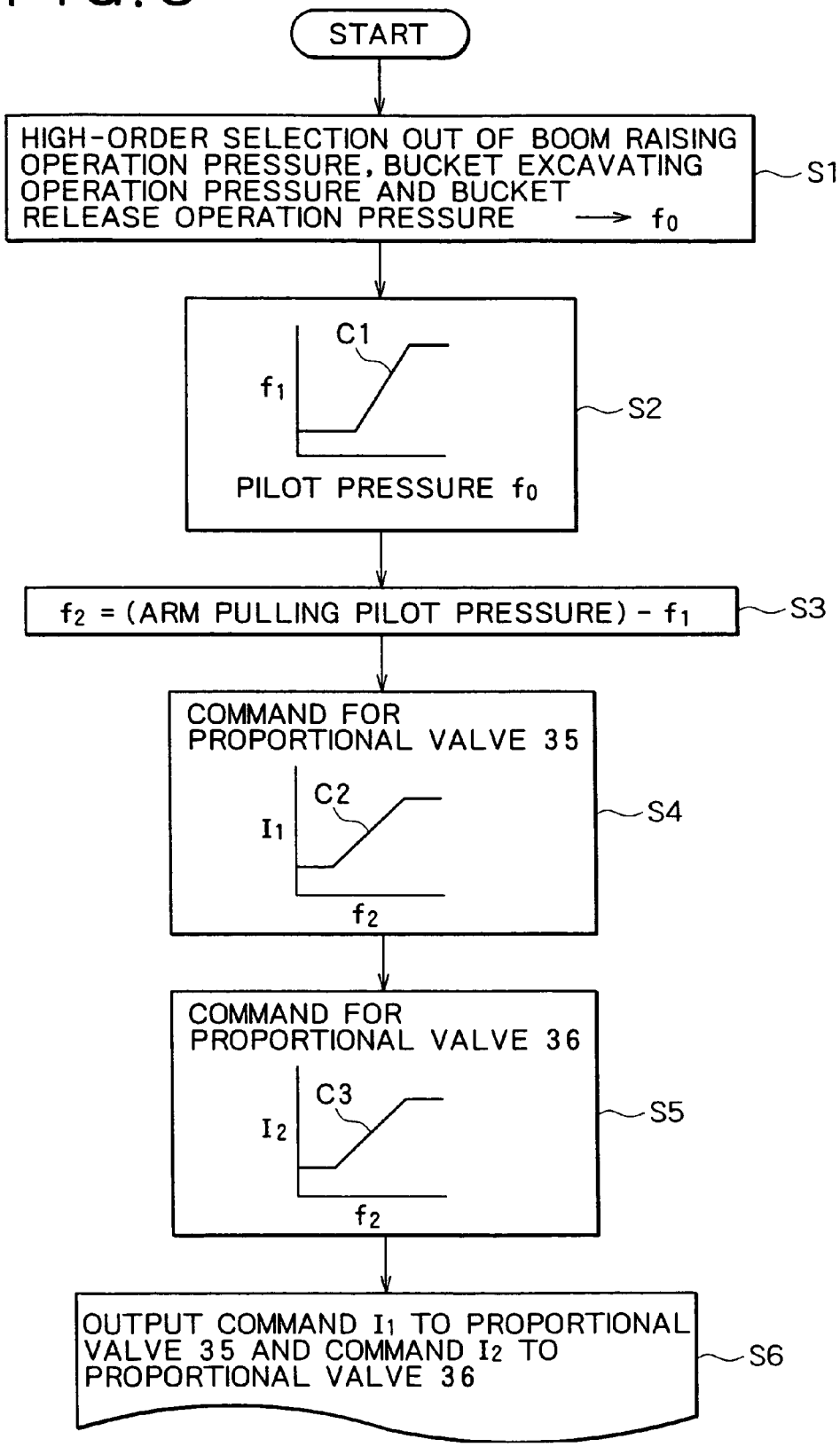
FIG. 3 is a flow chart showing contents of control made by a controller shown in FIG. 2.

As described in FIG. 3, within the controller 34 is pre-stored a map having a characteristic C1 such that a pressure f1 is kept to a minimum pressure in a region where the pilot pressure f0 selected by the high-order selection is less than a predetermined value and that the pressure f1 becomes higher as the pilot pressure f0 selected by the high-order selection rises. The pressure f1 corresponding to the selected pilot pressure f0 is determined on the basis of the map (step S2).

Next, a command f2 for the straight traveling valve 17 and the left cut-off valve 18 is determined in accordance with the following equation (step S3):

$$f2=(\text{arm pulling pilot pressure } S4)-f1$$

This calculation aims at suppressing f2 and canceling a confluence command for the straight traveling valve 17 in case of arm pulling and boom raising (or bucket excavation/bucket release) operations being performed simultaneously.

Then, a confluence command I1 for the proportional valve 35 is calculated on the basis of a map of the confluence command I1 which has characteristic C2 increasing with an increase of the f2 (step S4).

Next, a closing command I2 for the proportional valve 36 is calculated on the basis of the closing command I2 which has characteristic C3 increasing with an increase of the f2 (step S5).

Subsequently, the thus-determined confluence command I1 and closing command I2 are outputted to the proportional valves 35 and 36, respectively (step S6), whereby the straight traveling valve 17 and the left cut-off valve 18 are controlled.

That is, with an increase of f2, in other word, with a decrease of the f1 corresponding to the boom raising operation amount, the values of confluence command I1 and closing command I2 become higher, whereby the straight traveling valve 17 is gradually switched from the flow dividing position a to the confluence position b and the left cut-off valve 18 is also switched gradually from the communicating position e to the cut-off position f, whereby the pressure oil from the first hydraulic pump 2 and the pressure oil from the second hydraulic pump 3 are joined and fed to the arm cylinder control valve 10.

On the other hand, when the value of f2 is small under the boom raising operation or under the bucket excavation/bucket release, the confluence command I1 does not increase in the characteristic C2 and the closing command I2 does not increase, either, in the characteristic C3. Consequently, the proportional valves 35 and 36 do not operate and the pressure oil from the first hydraulic pump 2 and the pressure oil from the second hydraulic pump 3 do not join.

In this case, it is possible to ensure operating pressures of boom cylinder 13 and arm cylinder 10.

Although the invention has been described with reference to the preferred embodiments in the attached figures, it is noted that equivalents may be employed and substitutions made herein without departing from the scope of the invention as recited in the claims.

I claim:

1. A hydraulic control system for a hydraulic excavator, comprising:

a boom control valve adapted to provide pressure oil from a first hydraulic pump with a boom cylinder in accordance with operation of a boom operating means, said boom control valve being disposed in a first path;

an arm control valve adapted to provide pressure oil from a second hydraulic pump with an arm cylinder in accordance with operation of an arm operating means, said arm control valve being disposed in a second oil path;

a confluence switching valve adapted to switch between a confluence position for joining said pressure oil from said first and second oil paths and a confluence stop position for stopping said joining;

a flow control valve disposed in a return oil path for returning said pressure oil present in said first oil path to a tank; and a control means for controlling said confluence switching valve and said flow control valve by switching said confluence switching valve to the confluence position and making said flow control valve in a closed position when said arm operating means is operated independently, and by switching said confluence switching valve to the confluence stop position and making said flow control valve in an opened position when said arm operating means and said boom operating means are operated substantially simultaneously.

2. The hydraulic control system for a hydraulic excavator according to claim 1, further comprising a detecting means for detecting a boom raising operation amount by said boom operating means, and wherein said control means switches said confluence switching valve to the confluence position and switches said flow control valve in the closed position when the boom raising operation amount detected by said detecting means is not larger than a predetennined value.

3. The hydraulic control system for a hydraulic excavator according to claim 1, further comprising a detecting means for detecting a boom raising operation amount by said boom operating means and wherein said confluence switching valve and said flow control valve are switched between said confluence position and said confluence stop position and between said opened position and said closed position in proportion to said boom raising operation amount by said boom operating means.

4. The hydraulic control system for a hydraulic excavator according to claim 1, wherein a straight traveling valve is provided as said confluence switching valve, said straight traveling valve being adapted to switch between a first switching position in which said pressure oil from said first hydraulic pump and said pressure oil from said second hydraulic pump are fed each independently to said first oil path and said second oil path and thereby to a traveling motor disposed in said first oil path and a traveling motor disposed in said second oil path, and a second switching position in which said pressure oil from either said first hydraulic pump or said second hydraulic pump is distributed to each of said traveling motors.

* * * * *